US010524042B2

(12) United States Patent
Brousseau et al.

(10) Patent No.: US 10,524,042 B2
(45) Date of Patent: Dec. 31, 2019

(54) ELECTRO-ACOUSTICAL TRANSDUCER ARRANGEMENTS OF A SOUND SYSTEM

(71) Applicant: Bose Corporation, Framingham, MA (US)

(72) Inventors: Kevin Brousseau, Newton, MA (US); Greg J. Zastoupil, North Grafton, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/634,508

(22) Filed: Jun. 27, 2017

(65) Prior Publication Data

US 2018/0376240 A1 Dec. 27, 2018

(51) Int. Cl.

| | |
|---|---|
| ***H04R 5/02*** | (2006.01) |
| ***H04R 1/24*** | (2006.01) |
| ***H04R 1/02*** | (2006.01) |
| ***H04R 1/40*** | (2006.01) |
| ***H04R 3/14*** | (2006.01) |
| ***H04R 27/00*** | (2006.01) |
| ***H04R 1/30*** | (2006.01) |

(Continued)

(52) U.S. Cl.

CPC ..... *H04R 1/24* (2013.01); *H04R 1/025* (2013.01); *H04R 1/30* (2013.01); *H04R 1/403* (2013.01); *H04R 3/14* (2013.01); *H04R 27/00* (2013.01); *H04R 1/26* (2013.01); *H04R 1/323* (2013.01)

(58) Field of Classification Search

CPC ..... H04R 1/403; H04R 1/26; H04R 1/345; H04R 1/025; H04R 5/02; H04R 1/02; H04R 9/06; G10K 11/004

USPC ..... 381/182, 300, 386, 387

See application file for complete search history.

(56) References Cited

U.S. PATENT DOCUMENTS

| | | | |
|---|---|---|---|
| 3,779,551 | A | 12/1973 | Grodinsky |
| 4,227,051 | A | 10/1980 | Thomas et al. |

(Continued)

FOREIGN PATENT DOCUMENTS

| | | | |
|---|---|---|---|
| CN | 102026053 | B | 7/2013 |
| CN | 203178889 | U | 9/2013 |

(Continued)

OTHER PUBLICATIONS

Non-Final Office Action in U.S. Appl. No. 15/634,081 dated Jun. 13, 2018; 15 pages.

(Continued)

*Primary Examiner* — George C Monikang

(74) *Attorney, Agent, or Firm* — Schmeiser, Olsen & Watts LLP; Timothy P. Collins

(57) ABSTRACT

A speaker sound system assembly comprises an enclosure; a speaker mount housing covering the opening of the enclosure, the speaker mount housing including a hole that exposes an interior of the enclosure and concave horn walls on both sides of the hole; a first speaker positioned in the hole of the speaker mount housing, the horn walls of the speaker mount housing constructed and arranged to determine a shape of a coverage pattern of the first speaker; and a driver array comprising at least three second speakers and extending from one side of the speaker mount housing to the other side of the speaker mount housing in front of the first speaker, the speaker mount housing constructed and arranged to match a desired coverage pattern of the driver array.

20 Claims, 4 Drawing Sheets

(51) Int. Cl.

| | |
|---|---|
| *H04R 1/26* | (2006.01) |
| *H04R 1/32* | (2006.01) |

(56) References Cited

U.S. PATENT DOCUMENTS

| | | | | |
|---|---|---|---|---|
| 4,314,620 | A | 2/1982 | Gollehon | |
| 4,704,553 | A | 11/1987 | Resnicow | |
| 4,837,839 | A | 6/1989 | Andrews | |
| 5,771,154 | A | 6/1998 | Goodman et al. | |
| 6,243,472 | B1 | 6/2001 | Bilan et al. | |
| 6,259,798 | B1 | 7/2001 | Perkins et al. | |
| 6,453,378 | B1 | 9/2002 | Olson | |
| 6,477,799 | B1 | 11/2002 | Erickson et al. | |
| 6,723,913 | B1 | 4/2004 | Barbetta | |
| 6,944,024 | B1 | 9/2005 | Devine, III | |
| 7,302,061 | B2 | 11/2007 | Rivera | |
| 7,475,506 | B2 | 1/2009 | Hernandez et al. | |
| 8,051,592 | B2 | 11/2011 | Chang | |
| 8,126,180 | B2 | 2/2012 | Jacob et al. | |
| 8,135,158 | B2 | 3/2012 | Fincham | |
| 8,189,823 | B2 | 5/2012 | Tezuka et al. | |
| 8,561,756 | B2 | 10/2013 | Litovsky et al. | |
| 8,646,195 | B2 | 2/2014 | Fu et al. | |
| 9,294,842 | B2 | 3/2016 | Qiu | |
| 2006/0039571 | A1 | 2/2006 | Harris | |
| 2006/0083396 | A1 | 4/2006 | Kung | |
| 2010/0111342 | A1* | 5/2010 | Jacob | H04R 1/26 381/332 |
| 2011/0164774 | A1 | 7/2011 | Gladwin | |
| 2013/0022221 | A1 | 1/2013 | Kallai et al. | |
| 2013/0251188 | A1 | 9/2013 | Hatton et al. | |
| 2013/0314619 | A1 | 11/2013 | Sugiura | |
| 2014/0050344 | A1 | 2/2014 | Hilderman et al. | |
| 2015/0201255 | A1 | 7/2015 | Porter | |
| 2015/0281866 | A1 | 10/2015 | Williams et al. | |
| 2015/0289037 | A1 | 10/2015 | Kutil et al. | |
| 2016/0205466 | A1 | 7/2016 | Lim | |
| 2016/0337756 | A1 | 11/2016 | Oliveira et al. | |

FOREIGN PATENT DOCUMENTS

| | | | |
|---|---|---|---|
| CN | 203995589 | U | 12/2014 |
| CN | 205693881 | U | 11/2016 |
| CN | 205726396 | U | 11/2016 |
| CN | 205987244 | U | 2/2017 |
| DE | 202007015371 | U1 | 3/2009 |
| JP | 6269076 | A | 9/1994 |
| JP | 2000148027 | A | 5/2000 |
| JP | 200423148 | A | 1/2004 |
| JP | 2005300618 | A | 10/2005 |
| KR | 20020093316 | A | 12/2002 |
| TW | 201409433 | A | 3/2014 |
| TW | I448160 | B | 8/2014 |
| WO | 9903375 | A1 | 1/1999 |
| WO | 2007042047 | A2 | 4/2007 |
| WO | 2016135517 | A2 | 9/2016 |

OTHER PUBLICATIONS

Related U.S. Appl. No. 15/634,081, filed Jun. 27, 2017, 36 pages.
Related U.S. Appl. No. 15/634,740, filed Jun. 27, 2017, 20 pages.
Non-Final Office Action for U.S. Appl. No. 15/634,740, dated Mar. 6, 2018.
International Search Report and Written Opinion in International Patent Application No. PCT/US2018/028527 dated Jul. 13, 2018; 21 pages.
International Search Report and Written Opinion in International Patent Application No. PCT/US2018/033840 dated Jul. 23, 2018; 16 pages.
Notice of Allowance in U.S. Appl. No. 15/634,081 dated Feb. 14, 2019; 10 pages.
Final Office Action in related U.S. Appl. No. 15/634,081, dated Oct. 25, 2018; 20 pages.
Notice of Allowance in U.S. Appl. No. 15/634,740 dated Aug. 8, 2018; 8 pages.
International Search Report and Written Opinion in PCT/US2018/034357 dated Aug. 14, 2018; 21 pages.
Notice of Allowance in U.S. Appl. No. 16/373,000 dated Oct. 1, 2019; 10 pages.
Notice of Allowance in U.S. Appl. No. 15/634,740, dated Nov. 21, 2017; 9 pages.

* cited by examiner

ELECTRO-ACOUSTICAL TRANSDUCER ARRANGEMENTS OF A SOUND SYSTEM

RELATED APPLICATIONS

This application is related to U.S. Design Patent Application No. 29/597,171 entitled "Speaker," the content of which is incorporated herein by reference in its entirety.

BACKGROUND

This description relates generally to acoustic speakers, and more specifically, to portable powered public address (PA) speaker sound systems.

BRIEF SUMMARY

In accordance with one aspect, a speaker sound system assembly comprises an enclosure; a speaker mount housing covering the opening of the enclosure, the speaker mount housing including a hole that exposes an interior of the enclosure and concave horn walls on both sides of the hole; a first speaker positioned in the hole of the speaker mount housing, the horn walls of the speaker mount housing constructed and arranged to determine a shape of a coverage pattern of the first speaker; and a driver array comprising at least three second speakers and extending from one side of the speaker mount housing to the other side of the speaker mount housing in front of the first speaker, the speaker mount housing constructed and arranged to match a desired coverage pattern of the driver array; wherein: a middle second speaker of the at least three second speakers is between an adjacent upper second speaker and an adjacent lower second speaker, the middle second speaker positioned along a first longitudinal axis and a first plane of motion perpendicular to the first longitudinal axis; the upper second speaker of the at least three second speakers is positioned along a second longitudinal axis tangential to the first longitudinal axis and a second plane of motion perpendicular to the second longitudinal axis and tangential to the first plane of motion; and the lower second speaker of the at least three second speakers is positioned along a third longitudinal axis tangential to the first longitudinal axis and a third plane of motion perpendicular to the third longitudinal axis and tangential to the first plane of motion, and the first, second, and third longitudinal axes may be different from each other and the first, second, and third planes of motion are different from each other.

Aspects may include one or more of the following features.

The first, second, and third planes of motion may include circular-arc planes of motion according to the output of sound waves, and the first, second, and third circular-arc planes of motion may be tangential to each other.

The first, second, and third longitudinal axes and corresponding first, second, and third planes of motion, respectively, may be defined by the desired coverage pattern of the driver array.

The speaker mount housing may comprise a top coupling and a bottom coupling for receiving and positioning the driver array over the first speaker.

The top coupling may be configured to couple to the upper second speaker and orient the upper second speaker along the second longitudinal axis and the second plane of motion, and the bottom coupling maybe configured to couple to the lower second speaker and orient the lower second speaker along the third longitudinal axis and the third plane of motion.

The upper second speaker may be a topmost second speaker and the bottom second speaker may be a bottom-most second speaker.

The arc-shaped driver array may be further arranged in front of the first speaker in a circular-arc formation which is convex toward a direction in which the first speaker generates and outputs sound.

The first speaker may include a woofer and the second speakers may be high or mid-range frequency speakers.

The second speakers may be tweeters or other speakers that cover a frequency range at and lower than a frequency range of a tweeter.

At least two three-dimensional coordinates of an oriented position of the upper second speaker may be different than at least two dimensional coordinates of a position of the middle second speaker.

All three coordinates of the oriented position of the upper second speaker may be different than those of the position of the middle second speaker.

At least two three-dimensional coordinates of an oriented position of the lower second speaker may be different than at least two dimensional coordinates of a position of the middle second speaker.

All three coordinates of the oriented position of the lower second speaker may be different than those of the position of the middle second speaker.

The speaker mount housing may include a horn-shaped baffle configured to direct sound waves along any of the first, second, or third longitudinal axes.

The horn-shaped baffle may include a bevel for matching the desired coverage pattern of the driver array and configured to direct sound waves along the third longitudinal axes and the third plane of motion.

The speaker mount housing may include a flat baffle surrounding the hole, and for positioning about at least a portion of the first speaker.

The driver array may include an enclosure for providing an independent sealed acoustic volume for each second speaker, and the second speaker enclosures may be coupled to each other to form an arc-shape of the driver array.

In accordance with one aspect, a portable powered public address (PA) speaker system, comprises a horn-shaped speaker mount housing covering the opening of the enclosure, comprising: a concave wall that accommodates a desired sound coverage angle; and at least two bevels that further accommodates the desired sound coverage angle; a first speaker at the speaker mount housing; a driver array comprising at least three second speakers and extending from one side of the speaker mount housing to the other side of the speaker mount housing in front of the first speaker, the speaker mount housing constructed and arranged to match a desired coverage pattern of the driver array; wherein each of the at least three second speakers is along a unique longitudinal axis and a plane of motion perpendicular to the longitudinal axis.

In accordance with one aspect, an electro-acoustical transducer arrangement, comprises a middle speaker; a top speaker above the middle speaker; and a bottom speaker below the middle speaker, each of the at middle, top, and bottom speakers coupled to a horn-shaped baffle configured to permit a coverage area where each speaker extends along a unique longitudinal axis and a plane of motion perpendicular to the longitudinal axis.

The middle speaker may be positioned along a first longitudinal axis and a first plane of motion perpendicular to the first longitudinal axis, the top speaker may be positioned along a second longitudinal axis tangential to the first longitudinal axis and a second plane of motion perpendicular to the second longitudinal axis and tangential to the first plane of motion, the bottom speaker may be positioned along a third longitudinal axis tangential to the first longitudinal axis and a third plane of motion perpendicular to the third longitudinal axis and tangential to the first plane of motion, the first, second, and third longitudinal axes may be different from each other, and the first, second, and third planes of motion may be different from each other.

BRIEF DESCRIPTION

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Public address (PA) speaker systems are well-known for amplifying the reproduction of sound to be heard by a group of people. The environment in which portable (PA) speaker sound systems are used may vary from one location to another. Therefore, there is a need for portable (PA) speaker sound systems to accommodate different areas of coverage depending on the location, or other factors, such as the application, indoor or outdoor positioning, size of audience, and positioning of the speaker system.

Referring to the figures, a portable powered public address (PA) speaker sound system assembly 10 comprises an enclosure 22, also referred to as a woofer baffle, and a horn-shaped speaker mount housing 23, also referred to as a sectional horn assembly. In particular, the "horn" shape refers to a combination of surfaces that match the vertical and horizontal coverage angle of the loudspeaker transitioning between these two angles as the surface rotates about the acoustic axis. A plurality of electro-acoustic drivers, e.g., speakers, is coupled to the speaker mount housing 23 in the enclosure 22. In addition to the speakers, the enclosure 22 houses signal electronics, a control panel, a power source, and other electrical and mechanical components required for operation of the speaker sound system.

Figure 2:
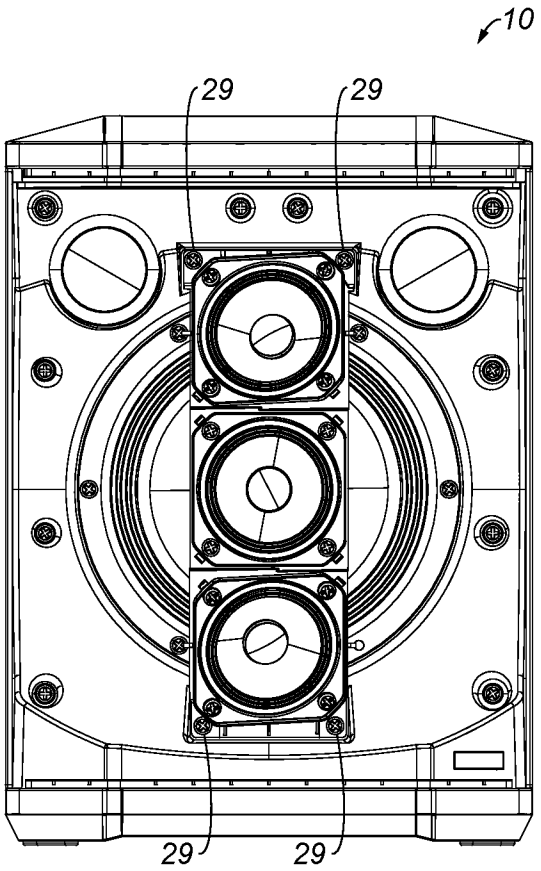
FIG. 2 is a front view of the portable powered public address (PA) speaker sound system assembly of FIG. 1.
Figure 3:
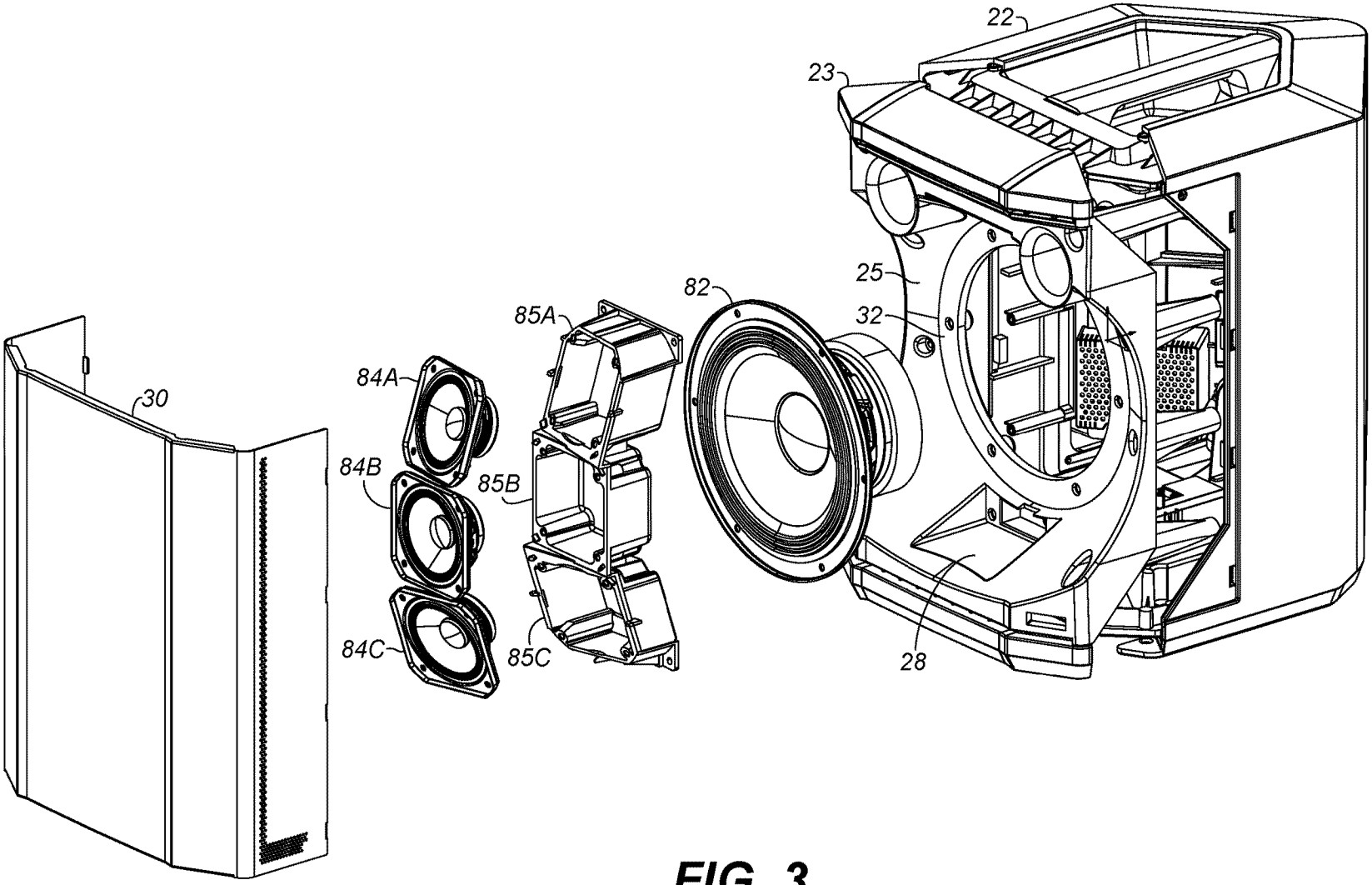
FIG. 3 is an exploded view of the portable powered public address (PA) speaker sound system assembly of FIGS. 1 and 2.
Figure 4:
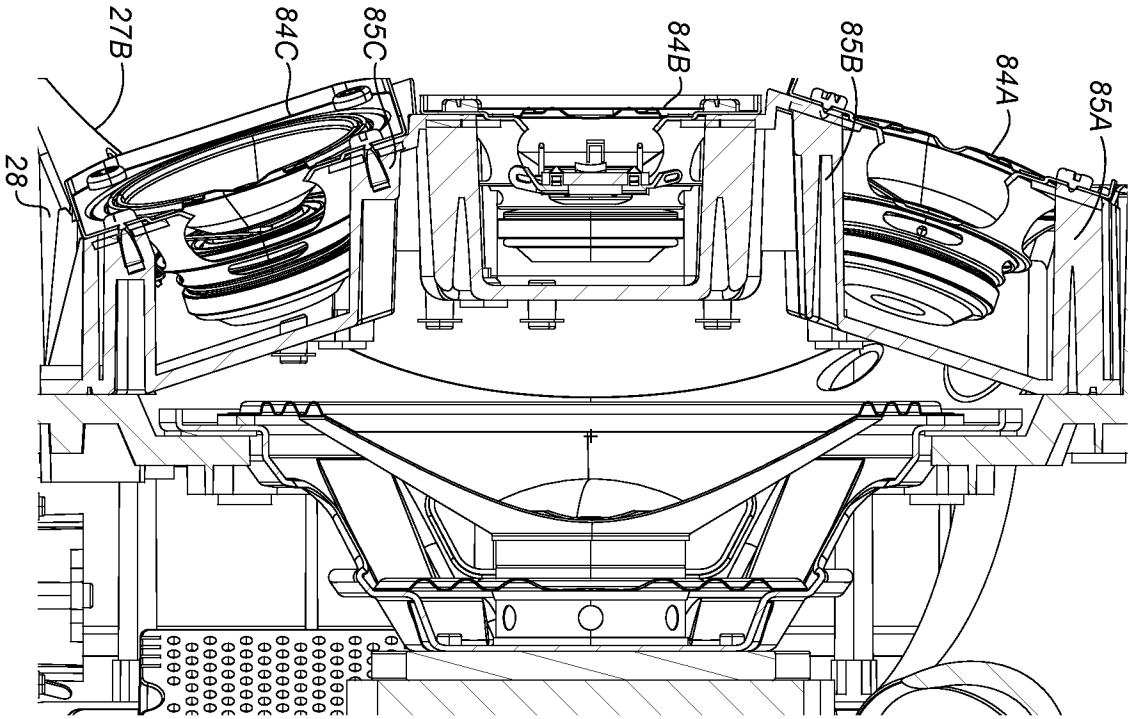
FIG. 4 is a cutaway top view of the portable powered public address (PA) speaker sound system assembly of FIGS. 1-3.

The enclosure 22 has a top, bottom, and three or more side surfaces extending between the top and bottom that form an interior, where the drivers and/or other electrical and mechanical components are positioned for providing relevant functionality of the sound system assembly 10. In some examples, the enclosure 22 may have a different number of side surfaces having various widths or other dimensions, for example, seven side surfaces as shown in FIGS. 1-3.

The horn-shaped speaker mount housing 23 is at a front region of the enclosure 22. In some examples, as shown in FIG. 3, the speaker mount housing 23 is formed separately, and coupled to, the enclosure 22 to form a front region of the enclosure 22. The speaker mount housing 23 may include two or more acoustic ports 92A, 92B (generally, 92) for permitting an air and/or acoustic flow path through the interior of the enclosure 22.

As described above, a plurality of electro-acoustic drivers, e.g., speakers, are coupled to the speaker mount housing 23 in the enclosure 22. In particular, the speaker mount housing 23 is constructed and arranged to receive and hold in place a first speaker 82 and a plurality of second speakers 84A-84C (generally, 84). The first speaker 82 may be a woofer or other low and/or mid frequency range drive units, although in other examples speaker 82 may have a different frequency range. The second speakers 84 may comprise three or more mid-to-high range, or full range drivers 84A-84C arranged as a driver array, and each constructed and arranged to emit sound waves in a higher-pitched sound range than the first speaker 82. In some examples, the second speakers 84 are tweeters or speakers that cover a frequency range at and lower than a frequency range of a tweeter, or other speaker that maintains a crossover at a significantly lower frequency which improves the efficiency of the system and also a smoother coverage pattern transition between the first speaker 82 and second speakers 84. A front grille, screen, or panel 30 (shown in FIG. 3) may be positioned over the speaker mount housing 23 but include openings, pores, and so on for allowing sound to be output from the speakers to an environment external to the sound system assembly 10.

Figure 1:
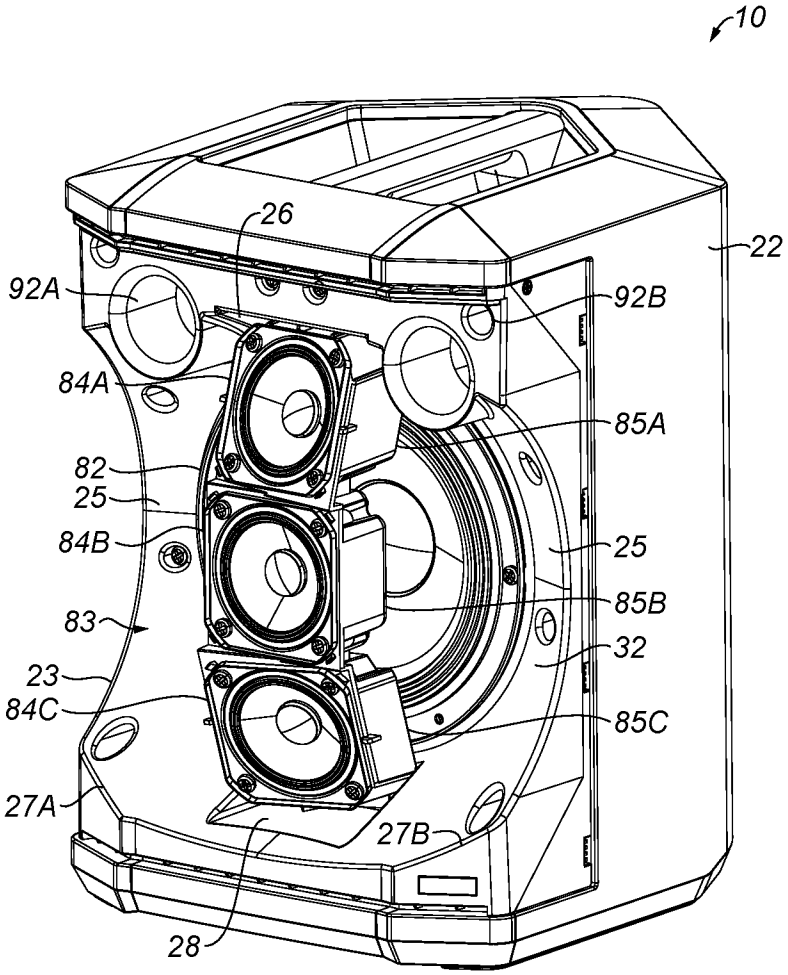
FIG. 1 is a perspective view of a portable powered public address (PA) speaker sound system assembly, in accordance with some examples.

As shown in FIG. 1, the first speaker 82 is attached to a baffle 32 of the speaker mount housing 23 at the front surface of the enclosure 22. The baffle 32 conforms to the geometry of the first speaker 82. For example, the acoustic horn 23 ends at the mounting surface of the first speaker 82. In some examples, this is a flat surface that attaches the first speaker 82 between a horn wall surface 25, also referred to as a horn shaped baffle, and first speaker 82. In other examples, the baffle 32 provides a mounting surface for both the first speaker 82 and driver array 84.

The speaker mount housing 23 has a specific horn shape to determine a shape of one or more coverage patterns for the first speaker 82. in particular, the shape of the speaker mount housing 23 provides for a desired sound coverage angle of the system 10. For example, the curved horn walls 25 may be concave when viewed from the front of We first speaker 82. In operation, the horn walls 25 conduct sound waves to the external environment and control the dispersion of the sound waves. A combination of horn shape and coupling configuration permits the driver array 84 to be as close as possible to the first speaker 82, allowing for a more portable enclosure package. Also, the curved shaped horn is at the desired coverage pattern of the speaker. The desire would be the horn shape to provide some level of control of the acoustic wave from the first speaker 82, which as is well known is frequency dependent.

Also, the curved horn shape allows extra acoustic volume on top, bottom, and sides of box while not affecting the horizontal and vertical coverage patterns, for example, by extending the flat surface of the baffle 32 to the outer edges of the horn walls 25 of the enclosure. A feature here is that as much acoustic volume as possible is allowed in a predetermined package size established by the enclosure configuration while maintaining a minimum size loudspeaker configuration. A larger acoustic volume has several benefits. The system is more efficient at low frequencies, for example, more bass with a larger box than a smaller box. Also, a shorter port maybe used avoiding interference with the rear of the enclosure while also allowing the system assembly to be shallower and therefore more portable.

In some examples, each of the second speakers 84A-C is positioned in an independent enclosure 85A-C, respectively, to collectively form an arc-shaped driver array 83. In particular, the driver enclosures 85A-C (generally, 85 collectively form a driver array baffle across a face of the first speaker 82, e.g., in front of the cone, surround, etc. where sound is output from the speaker 82. Each driver 84A-C may have an independent sealed acoustic volume, Each driver enclosure 85 is configured to orient the second speaker 84 therein in a unique position relative to the other second speakers in the driver array 83. To achieve this, each enclosure 85 may have a different shape to accommodate the unique orientation, or may have a same shape but oriented due to the configuration of the coupling of the speaker mount housing 23. In other examples, the driver array 83 includes a single enclosure for providing a shared acoustic volume for all second speakers.

For example, driver array enclosure 85A is configured to couple to a top coupling 26 in the speaker mount housing 23 in a unique position relative to the other second speakers in the driver array 83. Similarly, driver array enclosure 85C also configured to couple to a bottom coupling 28 in the speaker mount housing 23 in a unique position relative to the other second speakers in the driver array 83. Middle driver array enclosure 85B having middle second speaker 84B between enclosures 85A and 85C is also positioned differently than speakers 84A and 84C. A plurality of screws 29, rivets, or the like may be inserted through holes in the driver array enclosures 85A and 85C for holding the driver array 83 in place in the top and bottom couplings 26, 28. In some examples, the enclosures are molded into a single, or unitary, component having three separate enclosures 85A-C.

The couplings 26 and 28 may include cutouts in the body of the speaker mount housing 23, for example, between the two curved horn walls 25, allowing top 84A and bottom 84C second speakers to be directly coupled to the housing 23, with middle second speaker 84B between speakers 84A and C as close as possible. Also, housing 23 is constructed so that the coverage pattern of the second speakers 84 aligns with the coverage of the horn walls 25. In particular, top coupling 26 is shaped to receive upper second speaker 84A oriented at a transverse direction relative to a direction of a longitudinal axis extending through the acoustic center of the first speaker 84. Bottom coupling 28, on the other hand, is also shaped to receive lower second speaker 84C oriented at a transverse direction relative to a direction of a longitudinal axis extending through the acoustic center of the first speaker 84, except that the angle is oriented in a different transverse direction than the upper second speaker 84C. Thus, regardless of whether the speaker system 10 is positioned in a vertical, angled, or horizontal position, the coverage pattern offered by the system 10 may be fixed regarding of position. In other examples, a produced acoustic pattern is more narrow when oriented vertically than horizontally. To achieve a desired wide horizontal pattern, the system 10 may be positioned vertically. On the other hand, if a user desires a narrow horizontal pattern, the user can rotate the product by 90 degrees.

As described above, the second speakers 84 extending as an array 83 from one side of the speaker mount housing 23 to the other side of the speaker mount housing 23 in front of the first speaker 82. The second speakers 84 are preferably arranged as a curved or arc-shaped pattern, in particular, a curve characterized by a single radius of curvature or a complex curve characterized by more than one radii of curvature, such as a convex curve toward a direction in which the first speaker 82 emits sound.

As described above, the middle second speaker 84B of the second speakers is between two other second speakers 84A and 84C, but not limited thereto, since more than two second speakers may be between speakers 84A-8C, any or all of which may also be referred to as middle speakers. In particular, shown in FIG. 5, the middle second speaker 84B is positioned along and is collinear to the longitudinal axis of the first speaker's 82 driver's voice coil and therefore, the middle second speaker 84B can output acoustic radiation, e.g., sound waves produced by the vibrational motion of the speaker diaphragm, in a same general direction as the first speaker's sound waves. In other examples, such as when two or more middle speakers 84B are provided or when a single middle second speaker 84B has a different orientation, the middle second speaker 84B may not be collinear with the first speaker 82, and may instead extend in a longitudinal direction that is tangential to that of the first speaker 82.

The longitudinal axis of the middle second speaker 84B may he referred to as a reference axis, first axis, or z axis, in particular, referring to a three dimensional Cartesian coordinate system. A plane of motion of the middle speaker diaphragm perpendicular to the longitudinal axis of the middle second speaker 84B may be referred to as a reference plane of motion, or first plane of motion, or x-y plane. It is well-known that a sound wave propagates radially outward from an oscillating speaker diaphragm. Thus, the horn shape of the enclosure 22 may establish, or control, the direction of propagation of the sound waves from any or all of the speakers in the enclosure 22. For example, the sound waves are output as a series of concentric circular arcs, or wave fronts. The z axis of the middle second speaker 84B may intersect a planar wave front, which in turn is perpendicular to the x-y plane of motion. The middle second speaker 84B may therefore output sound waves in a three dimensional direction comprising a first or reference longitudinal axis (z) and corresponding first or reference plane of motion comprising the x and y axes. The horn shape creates a pattern that matches that of the second speakers 84.

Figure 5:
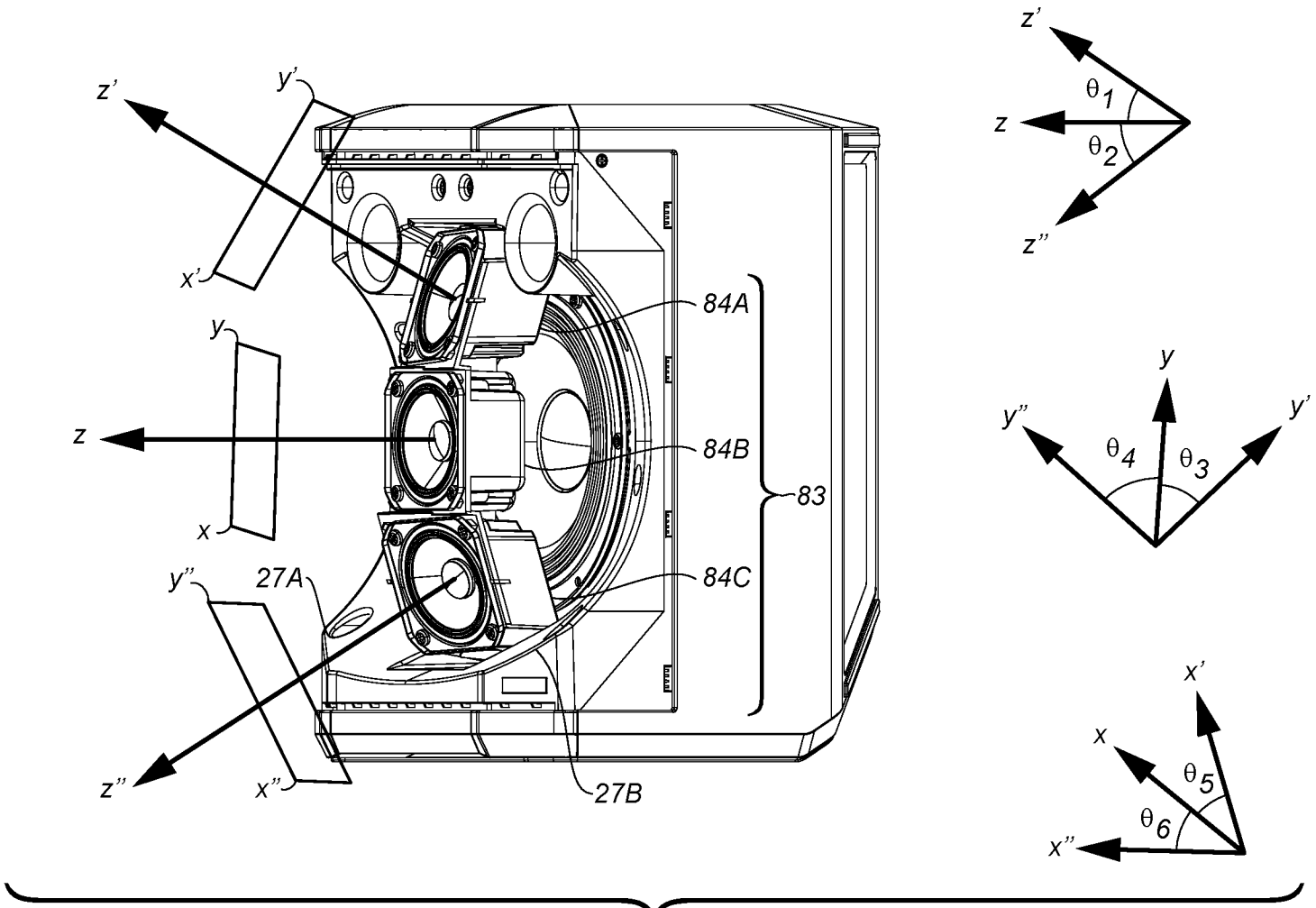
FIG. 5 is another view of the driver array of FIGS. 1-4, including illustrations of directions of sound output of each speaker in the driver array and speaker orientation angles.

As also shown in FIG. 5, the upper second speaker 84A is positioned along a second longitudinal axis (z') that is tangential to the co-linear reference axis (z) of the middle second speaker 84B and first speaker 82 driver. The upper speaker diaphragm also vibrates, and generates sound waves, along the z' axis, which in turn is perpendicular to an x'-y' plane of motion. The x'-y' plane of the upper second speaker 84A is tangential to the x-y plane of the middle second speaker 84B. Therefore, one or both the x' and y' axes is tangential to the x and y axes, respectively. In some examples, the x'-y' plane of motion may be a second circular-arc plane of motion tangential to a first circular-arc plane of motion of that of the middle second speaker 84B.

More specifically, the upper second speaker 84A as compared to the reference direction (z) and x-y plane is rotated at least partially about both the x axis and y axis to vibrate and output acoustic radiation, or sound waves, in a different direction, i.e., x', y', and z' direction, one or more being different than x, y, and z accordingly.

Referring again to FIG. 5, the lower second speaker 84C is positioned along a longitudinal axis (z"), or third longitudinal axis, that is tangential to the reference axis z. The lower speaker diaphragm also vibrates, and generates sound waves, along the z" axis, which in turn is perpendicular to an x"-y" plane of motion. The x"-y" plane of the lower second speaker 84C is tangential to the x-y plane of the middle second speaker 84B. Therefore, one or both the x" and y" axes is tangential to the x and y axes, respectively. In some examples, the x"-y" plane of motion of the lower speaker 84C may be a third circular-arc plane of motion tangential to a first circular-arc plane of motion of that of the middle second speaker 84B.

More specifically, the lower second speaker 84C as compared to the reference direction (z) and x-y plane is rotated at least partially about both the x axis and y axis to vibrate and output acoustic radiation, or sound waves, in a different direction, i.e., x", y", and z" direction, each being different than x, y, and z accordingly.

Shown more specifically in FIG. 5, x' axis of upper second speaker 84A may be oriented at an angle $\theta_1$ relative to x axis of the middle second speaker 84B. Also as shown in FIG. 5, x" axis of lower second speaker 84B may be oriented at an angle $\theta_2$ relative to x axis of the middle second speaker 84B.

Also shown more specifically in FIG. 5, z' axis of upper second speaker 84A may be oriented at an angle $\theta_3$ relative to z axis of the middle second speaker 84B. Also as shown in FIG. 5, z" axis of lower second speaker 84B may be oriented at an angle $\theta_4$ relative to x axis of the middle second speaker 84B.

What is claimed is:

1. A speaker sound system assembly, comprising:

an enclosure defining an opening;

a speaker mount housing covering the opening of the enclosure, the speaker mount housing including a hole that exposes an interior of the enclosure and concave horn walls on both sides of the hole;

a first speaker positioned in the hole of the speaker mount housing, the horn walls of the speaker mount housing constructed and arranged to determine a shape of a coverage pattern of the first speaker; and a driver array comprising at least three second speakers and extending from one side of the speaker mount housing to the other side of the speaker mount housing in front of the first speaker, the speaker mount housing constructed and arranged to match a desired coverage pattern of the driver array; wherein:

a middle second speaker of the at least three second speakers is between an adjacent upper second speaker and an adjacent lower second speaker, the middle second speaker and the first speaker positioned along a first longitudinal axis, which in turn extends through a first plane of motion of a diaphragm of the middle second speaker formed by two axes, each perpendicular to the first longitudinal axis;

the upper second speaker of the at least three second speakers is positioned along a second longitudinal axis tangential to the first longitudinal axis and a second plane of motion of a diaphragm of the upper second speaker formed by two axes each perpendicular to the second longitudinal axis and tangential to the first plane of motion, each of the second speakers having a stand-alone independent enclosure such that a bottom surface of the enclosure of the upper second speaker is directly adjacent above and oriented to one of a left or right of the middle second speaker; and the lower second speaker of the at least three second speakers is positioned along a third longitudinal axis tangential to the first longitudinal axis and a third plane of motion of a diaphragm of the lower second speaker formed by two axes each perpendicular to the third longitudinal axis and tangential to the first plane of motion such that a top surface of the enclosure of the lower second speaker is directly adjacent below and oriented to another of the left or right of the middle second speaker different than the one of the left or right of the upper second speaker relative to the middle second speaker, wherein the first, second, and third longitudinal axes along which the middle, upper, and lower second speakers are respectively positioned are different from each other, and wherein the two axes forming the second of motion and the second longitudinal axis along which the upper second speaker is positioned each extends in a different direction than the two axes forming the third plane of motion and the third longitudinal axis.

2. The speaker sound system assembly of claim 1, wherein the first, second, and third planes of motion include circular-arc planes of motion according to the output of sound waves, and wherein the first, second, and third circular-arc planes of motion are tangential to each other.

3. The speaker sound system assembly of claim 2, wherein the first, second, and third longitudinal axes and corresponding first, second, and third planes of motion, respectively, are defined by the desired coverage pattern of the driver array.

4. The speaker sound system assembly of claim 1, wherein the speaker mount housing comprises a top coupling and a bottom coupling for receiving and positioning the driver array over the first speaker.

5. The speaker sound system assembly of claim 4, wherein the top coupling is configured to couple to the upper second speaker and orient the upper second speaker along the second longitudinal axis and the second plane of motion, and wherein the bottom coupling is configured to couple to the lower second speaker and orient the lower second speaker along the third longitudinal axis and the third plane of motion.

6. The speaker sound system assembly of claim 5, wherein the upper second speaker is a topmost second speaker and the bottom second speaker is a bottommost second speaker.

7. The speaker sound system assembly of claim 1, wherein the driver array is further arranged in front of the first speaker in a circular-arc formation which is convex toward a direction in which the first speaker generates and outputs sound.

8. The speaker sound system assembly of claim 1, wherein the first speaker includes a woofer and the second speakers are high or mid-range frequency speakers.

9. The speaker sound system assembly of claim 8, wherein the second speakers are tweeters or other speakers that cover a frequency range at and lower than a frequency range of a tweeter.

10. The speaker sound system assembly of claim 1, wherein at least two three-dimensional coordinates of an oriented position of the upper second speaker are different than at least two dimensional coordinates of a position of the middle second speaker.

11. The speaker sound system assembly of claim 10, wherein all three coordinates of the oriented position of the upper second speaker are different than those of the position of the middle second speaker.

12. The speaker sound system assembly of claim 1, wherein at least two three-dimensional coordinates of an oriented position of the lower second speaker are different than at least two dimensional coordinates of a position of the middle second speaker.

13. The speaker sound system assembly of claim 12, wherein all three coordinates of the oriented position of the lower second speaker are different than those of the position of the middle second speaker.

14. The speaker sound system assembly of claim 1, wherein the speaker mount housing includes a horn-shaped baffle configured to direct sound waves along any of the first, second, or third longitudinal axes.

15. The speaker sound system assembly of claim 14, wherein the horn-shaped baffle includes a bevel for matching the desired coverage pattern of the driver array and configured to direct sound waves along the third longitudinal axes and the third plane of motion.

16. The speaker sound system assembly of claim 1, wherein the speaker mount housing includes a flat baffle surrounding the hole, and for positioning about at least a portion of the first speaker.

17. The speaker sound system assembly of claim 1, wherein the driver array includes an enclosure for providing an independent sealed acoustic volume for each second speaker, the second speaker enclosures coupled to each other to form an arc-shape of the driver array.

18. A portable powered public address (PA) speaker system, comprising:

a horn-shaped speaker mount housing covering the opening of the enclosure, comprising:

a concave wall that accommodates a desired sound coverage angle; and at least two bevels that further accommodates the desired sound coverage angle;

a first speaker at the speaker mount housing;

a driver array comprising at least three second speakers and extending from one side of the speaker mount housing to the other side of the speaker mount housing in front of the first speaker, the speaker mount housing constructed and arranged to match a desired coverage pattern of the driver array; wherein each of the at least three second speakers is along a unique longitudinal axis and a plane of motion of a diaphragm of the at least three second speakers formed by two axes each perpendicular to the longitudinal axis, wherein each of the second speakers has a standalone independent enclosure such that a bottom surface of the enclosure of an upper second speaker is directly adjacent above and oriented to one of a left or right of a middle second speaker and a top surface of the enclosure of a lower second speaker is directly adjacent below and oriented to another of the left or right of the middle second speaker different than the one of the left or right of the upper second speaker relative to the middle second speaker, and wherein each of the two axes forming each of the planes of motion of the upper second speaker and the longitudinal axis of the upper second speaker extends in a different direction than the two axes of the plane of motion and the longitudinal axis of the lower second speaker.

19. An electro-acoustical transducer arrangement, comprising:

a middle speaker;

a top speaker above the middle speaker; and a bottom speaker below the middle speaker, each of the at middle, top, and bottom speakers coupled to a horn-shaped baffle configured to permit a coverage area where each speaker extends along a unique longitudinal axis and a plane of motion of a diaphragm of the speakers formed by two axes each perpendicular to the longitudinal axis, and wherein each of the two perpendicular axes forming each of the planes of motion of the middle, top, and bottom speakers and the longitudinal axis of each of the middle, top, and bottom speakers extends in a different direction than the two axes of the planes of motion and longitudinal axes of the other of the middle, top, and bottom speakers, wherein:

each of the top, middle, and bottom speakers has a standalone independent enclosure such that a bottom surface of the enclosure of the top speaker is directly adjacent above and oriented to one of a left or right of a middle speaker and a top surface of the enclosure of the bottom speaker is directly adjacent below and oriented to another of the left or right of the middle speaker different than the one of the left or right of the top speaker relative to the middle speaker.

20. The arrangement of claim 19, wherein the middle speaker is positioned along a first longitudinal axis and a first plane of motion perpendicular to the first longitudinal axis, the top speaker is positioned along a second longitudinal axis tangential to the first longitudinal axis and a second plane of motion perpendicular to the second longitudinal axis and tangential to the first plane of motion, and the bottom speaker is positioned along a third longitudinal axis tangential to the first longitudinal axis and a third plane of motion perpendicular to the third longitudinal axis and tangential to the first plane of motion, wherein the first, second, and third longitudinal axes are different from each other and the first, second, and third planes of motion are different from each other.

* * * * *